US006276755B1

(12) United States Patent
Su

(10) Patent No.: US 6,276,755 B1
(45) Date of Patent: Aug. 21, 2001

(54) SWIVEL ARRANGEMENT FOR A CHAIR SEAT

(76) Inventor: Tung-Hua Su, No. 16, Alley 23, Lane 900, Min Sheng St., Kuei Jen, Tainan Hsien (TW)

( * ) Notice: Subject to any disclaimer, the term of this patent is extended or adjusted under 35 U.S.C. 154(b) by 0 days.

(21) Appl. No.: 09/436,449

(22) Filed: Nov. 9, 1999

(51) Int. Cl.[7] ..... A47C 3/026

(52) U.S. Cl. ..... 297/285; 297/300.4; 297/300.5; 297/300.7; 297/301.4; 297/301.6; 297/302.4; 297/302.6

(58) Field of Search ..... 297/285, 300.4, 297/300.5, 300.7, 301.4, 301.6, 302.4, 302.6, 344.19

(56) References Cited

U.S. PATENT DOCUMENTS

| | | | | |
|---|---|---|---|---|
| 3,356,414 | * | 12/1967 | Doerner | 297/300.5 |
| 4,123,103 | * | 10/1978 | Doerner | 297/301.4 |
| 4,664,445 | * | 5/1987 | Groseth | 297/302.6 X |
| 5,066,069 | * | 11/1991 | DeGelder | 297/300.4 X |
| 5,222,783 | * | 6/1993 | Lai | 297/301.4 |
| 5,447,357 | * | 9/1995 | Dauphin | 297/301.4 |
| 6,039,398 | * | 3/2000 | Gorgi et al. | 297/301.4 X |
| 6,120,096 | * | 9/2000 | Miotto | 297/300.5 X |
| 6,131,998 | * | 10/2000 | Su | 297/300.5 X |

* cited by examiner

*Primary Examiner*—Peter M. Cuomo
*Assistant Examiner*—Rodney B. White
(74) *Attorney, Agent, or Firm*—Rosenberg, Klein & Lee

(57) ABSTRACT

A swivel arrangement is provided for a chair having a backrest, a chair seat, a chassis, and a base. The chassis includes a swivel seat mounted to an underside of the chair seat, a first connecting seat, a second connecting seat, a spring seat, a control device, and an adjusting rod. The swivel seat includes a hole and a stop adjacent to the hole. The control device includes a pressing plate engaged with an inner end of the adjusting rod and an operative block with a pressing portion. The first connecting seat, the swivel seat, and the second connecting seat are connected by axle rods. The adjusting rod is movable along a longitudinal axis thereof between a first position and a second position, wherein when the adjusting rod is in the first position, the pressing portion of the operative block is aligned with the hole of the swivel seat to allow back-and-forth swivel movements of the swivel seat and the second connecting seat, and wherein when the adjusting rod is in the second position, the pressing portion of the operative block is aligned with and thus stopped by the stop of the swivel seat to thereby prevent back-and-forth swivel movements of the swivel seat and the second connecting seat. When the second connecting seat swivels rearward, the swivel seat swivels rearward by an angular displacement smaller than that of the second connecting seat.

2 Claims, 11 Drawing Sheets

SWIVEL ARRANGEMENT FOR A CHAIR SEAT

BACKGROUND OF THE INVENTION

1. Field of the Invention

The present invention relates to a swivel arrangement for a chair seat that provides improved sitting comfort and safety and easier operation and assembly.

2. Description of the Related Art

A typical chair is shown in FIGS. 10 and 11 and includes a backrest 1', a chair seat 2', a chassis 3', a pneumatic rod 4', and a base 5'. A lower end of the backrest 1' is connected to the chair seat 2'. The chassis 3' includes a swivel seat 31', a connecting seat 32', a spring seat 33', an adjusting rod 34', and a connecting rod 35'. The swivel seat 31' includes a number of holes 311' in corner areas thereof for connection with the chair seat 2', a hole 312' in a mediate portion thereof for connection with the spring seat 33', and lateral holes 313' and 314' through which the adjusting rod 34' and the connecting rod 35 extend, respectively. The connecting seat 32' includes a hole 321' through which the pneumatic rod 4' extends. The connecting seat 32' further includes lateral holes 322' and 323' through which the adjusting rod 34' and the connecting rod 35 extend, respectively. The connecting seat 32' further includes a hole 324' for mounting the spring seat 33'. The spring seat 33' includes a sleeve 332', a spring 331' partially mounted in the sleeve 332', and a threaded rod 333' that extends through the hole 312' in the swivel seat 31' and securely engages with a lower end of the sleeve 332'. The adjusting rod 34' includes an end 341' extended through the lateral hole 313' to restrain swivel movement of the swivel seat 31'. The adjusting rod 34' further includes a pressing section 342' to press against an upper end of the pneumatic rod 4' to adjust the level of the chair seat 2'.

Although the seat 2' and the backrest 1' can be swiveled due to provision of the spring 331', the inclination angle of the backrest 1' relative to the seat 2' cannot be fixed. In addition, as shown in FIG. 12, the user might fall from the chair when the rearward motion of the backrest 1' goes too far, since the seat 2' swivels together with the backrest 1'.

FIG. 13 of the drawings illustrates another conventional chair that includes a backrest 6' that is connected to a movable seat 62' via a connection rod 61'. The movable seat 62' is connected to a chassis 7' that includes an elastic means 71' to allow back-and-forth swivel motion of the backrest 6'. The chair seat 8' and the backrest 6' are secured together to provide improved sitting stability and safety. Two control rods (not labeled) are attached to the chassis 7' to respectively control the level of the backrest 6' and swivel motion of the backrest 6'. Nevertheless, the chair seat 8' is thoroughly fixed and thus provides less sitting comfort. In addition, two control rods are required to control the level and inclination angle of the backrest 6' and thus result in inconvenient operation to the user and inconvenient assembly.

SUMMARY OF THE INVENTION

In accordance with the present invention, a swivel arrangement is provided for a chair having a backrest, a chair seat, a chassis, and a base. The chassis includes a swivel seat mounted to an underside of the chair seat, a first connecting seat, a second connecting seat, a spring seat, a control device, and an adjusting rod. The swivel seat includes a hole and a stop adjacent to the hole. The control device includes a pressing plate engaged with an inner end of the adjusting rod and an operative block with a pressing portion. The first connecting seat, the swivel seat, and the second connecting seat are connected by axle rods. The adjusting rod is movable along a longitudinal axis thereof between a first position and a second position, wherein when the adjusting rod is in the first position, the pressing portion of the operative block is aligned with the hole of the swivel seat to allow back-and-forth swivel movements of the swivel seat and the second connecting seat, and wherein when the adjusting rod is in the second position, the pressing portion of the operative block is aligned with and thus stopped by the stop of the swivel seat to thereby prevent back-and-forth swivel movements of the swivel seat and the second connecting seat. When the second connecting seat swivels rearward, the swivel seat swivels rearward by an angular displacement smaller than that of the second connecting seat.

Other objects, advantages, and novel features of the invention will become more apparent from the following detailed description when taken in conjunction with the accompanying drawings.

DETAILED DESCRIPTION OF THE PREFERRED EMBODIMENT

Figure 4:
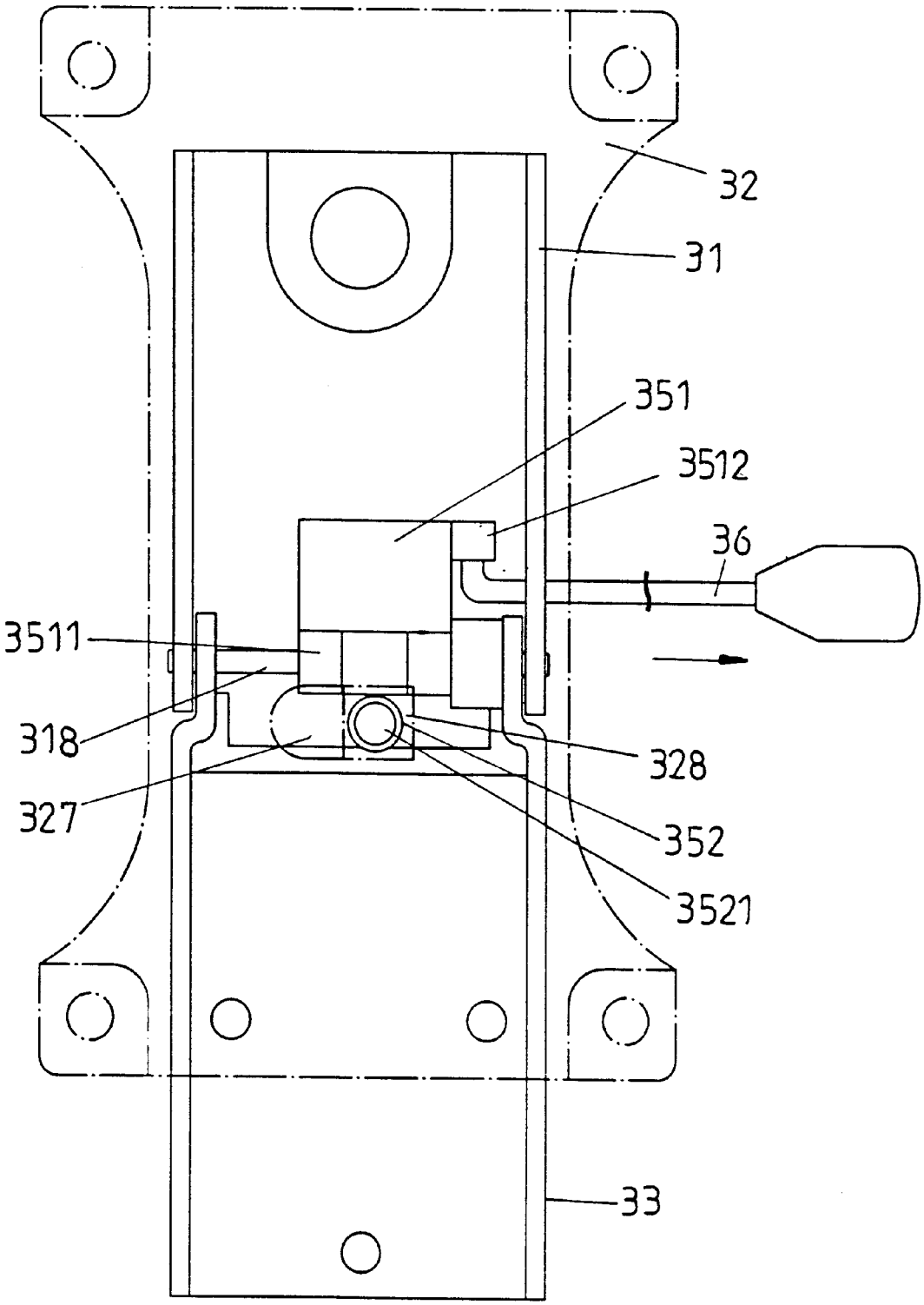
FIG. 4 is a top view of the chair seat chassis in accordance with the present invention, where an adjusting rod is pulled outward.
Figure 5:
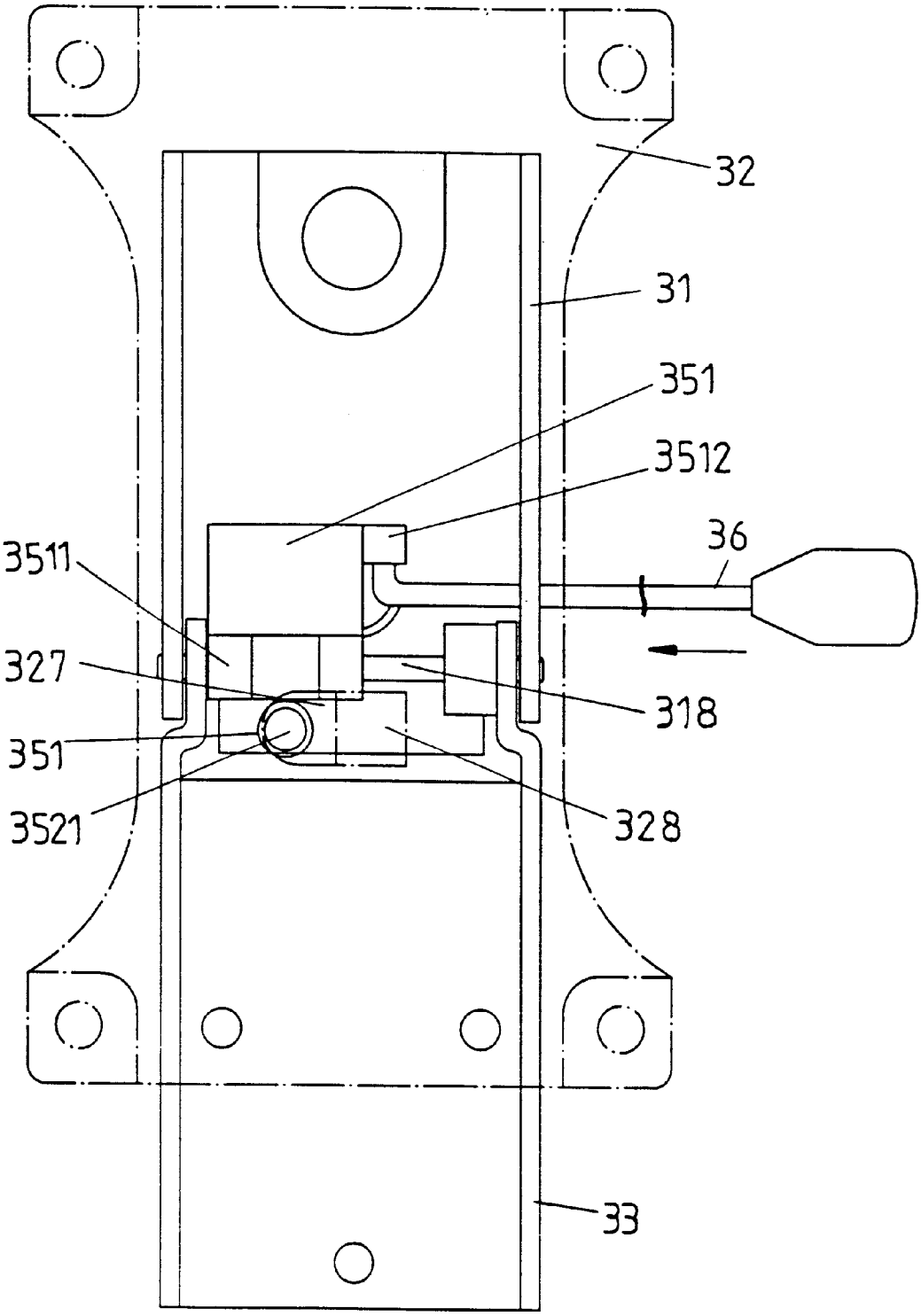
FIG. 5 is a top view similar to FIG. 4, wherein the adjusting rod is pushed inward.
Figure 6:
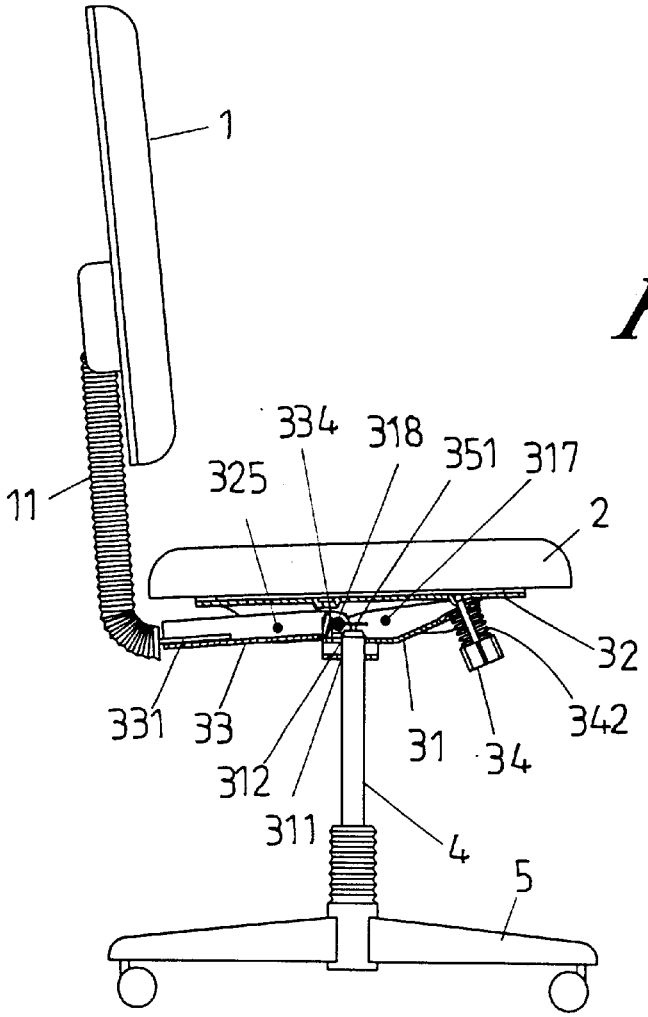
FIG. 6 is a side view, partly sectioned, of a chair with the chair seat chassis in accordance with the present invention.

Referring to FIGS. 1 through 9 and initially to FIG. 6, a chair generally includes a backrest 1, a chair seat 2, a chassis 3, a pneumatic rod 4, and a base 5. Referring to FIGS. 1 through 4, the chassis 3 in accordance with the present invention includes a first connecting seat 31, a swivel seat 32, a second connecting seat 33, a spring seat 34, a control device 35, and an adjusting rod 36. The first connecting seat 31 includes an engaging section 311 with an engaging hole 312 through which the pneumatic rod 4 extends. Defined in a front end of the first connecting seat 31 is a hole 313 through which a threaded rod 341 of the spring seat 34 extends. The first connecting seat 31 further includes a hole 314 in a lateral side thereof through which the adjusting rod 36 extends. Also defined in the lateral side of the first connecting seat 31 are two axle holes 315 and 316 through which axle rods 317 and 318 extend, respectively.

The swivel seat 32 includes a number of holes 321 in comer areas thereof for connection with the chair seat 2 (FIG. 5). The swivel seat 32 further includes a hole 322 in a lateral side thereof through which the adjusting rod 36 extends. Also defined in the lateral side of the swivel seat 32 are two axle holes 323 and 324 through which axle rods 317 and 325 extend, respectively. Defined in a front end of the swivel seat 32 is a hole 326 through which the threaded rod 341 of the spring seat 34 extends. The swivel seat 32 further includes a hole 328 and a stop 327 formed adjacent to the hole 328. Axle rod 317 extends through the hole 315 in the first connecting seat 31 and the hole 323 in the swivel seat 32 to thereby connect the first connecting seat 31 with the swivel seat 32.

The second connecting seat 33 includes an engaging section 331 at an end thereof for connection with the backrest 1 via a connecting post 11 (FIG. 5). The other end of the connecting seat 33 includes aligned axle holes 333 in two lateral sides thereof. Axle rod 325 extends through the axle holes 333 in the second connecting seat 33 and hole 324 in the swivel seat 32 to thereby connect the second connecting seat 33 with the swivel seat 2. Each lateral side of the second connecting seat 33 includes an extension 334 with a hole 332. The distance between the extensions 334 may be smaller than that between the lateral sides of the second connecting seat 33. Each extension 334 includes an inclined top surface (not labeled). Axle rod 318 extends through the hole 316 in the first connecting seat 31 and holes 332 in the second connecting seat 33 to thereby connect the second connecting seat 33 with the first connecting seat 31. The axle holes 333 are located in a position such that the swivel seat 32 swivels rearward by a smaller angular displacement when the connecting seat 33 swivels rearward by a larger angular displacement.

The spring seat 34 includes a threaded rod 341, a spring 342, and a sleeve 343 and is connected to a front end of an underside of the first connecting seat 31. The threaded rod 341 is extended through the hole 326 in the swivel seat 32 and the hole 313 in the first connecting seat 31 with a threaded end of the threaded rod 341 engaged with a bottom end of the sleeve 343 and with an upper end of the spring 342 bearing against the underside of the first connecting seat 31.

Figure 1:
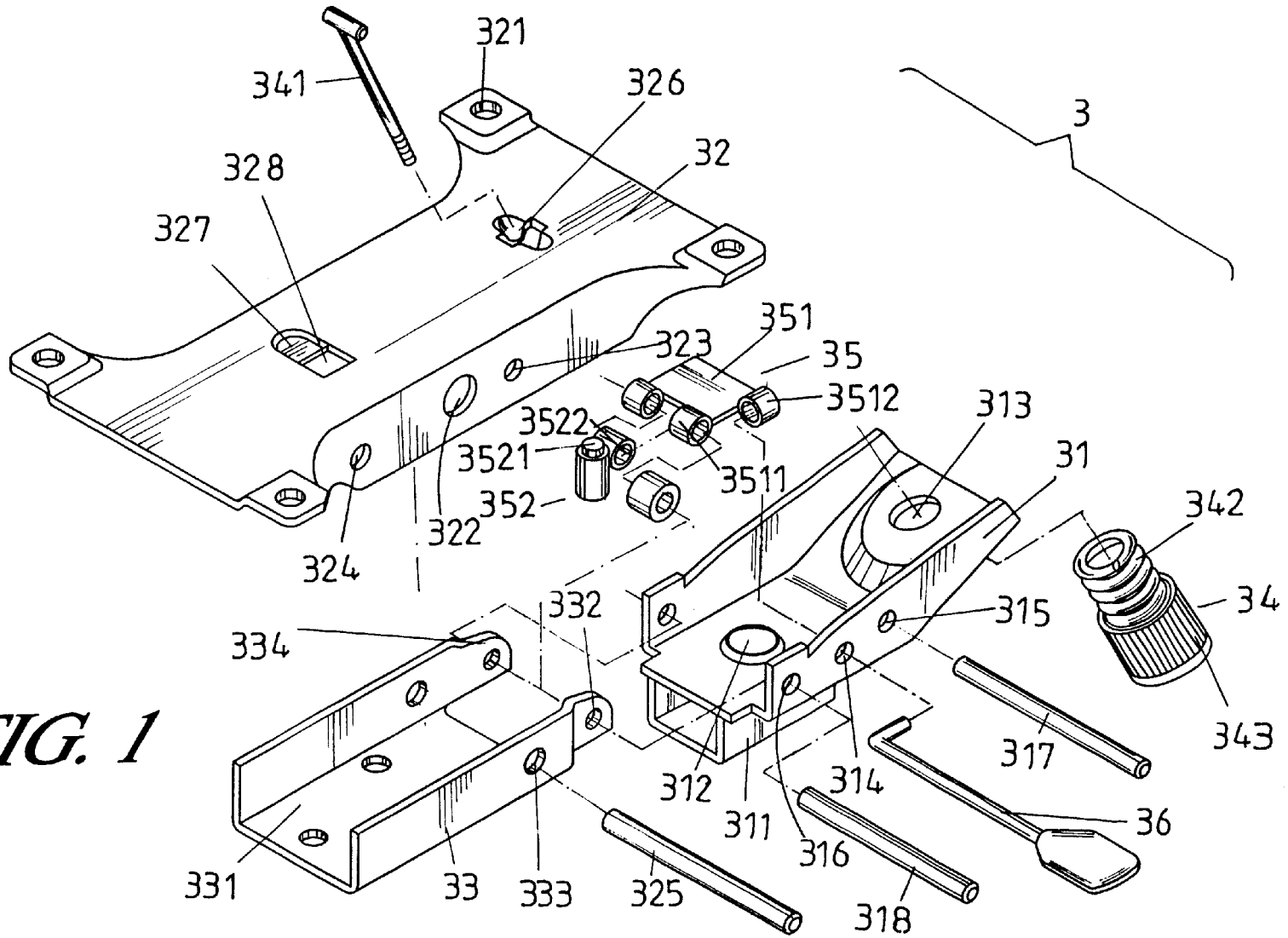
FIG. 1 is an exploded perspective view of a chair seat chassis in accordance with the present invention.
Figure 2:
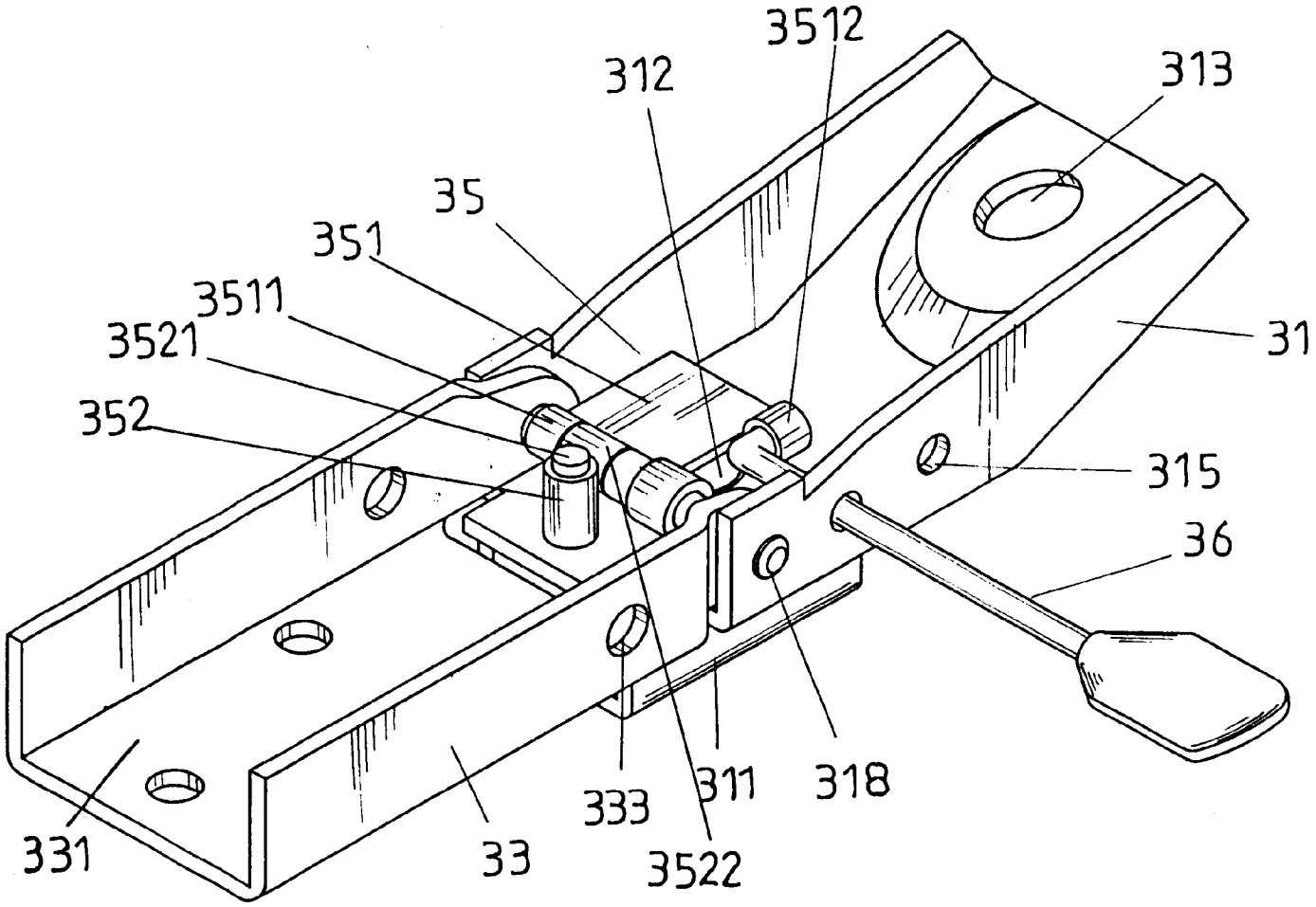
FIG. 2 is a perspective view of the chair seat chassis in accordance with the present invention, wherein a swivel seat is omitted for clarity.
Figure 3:
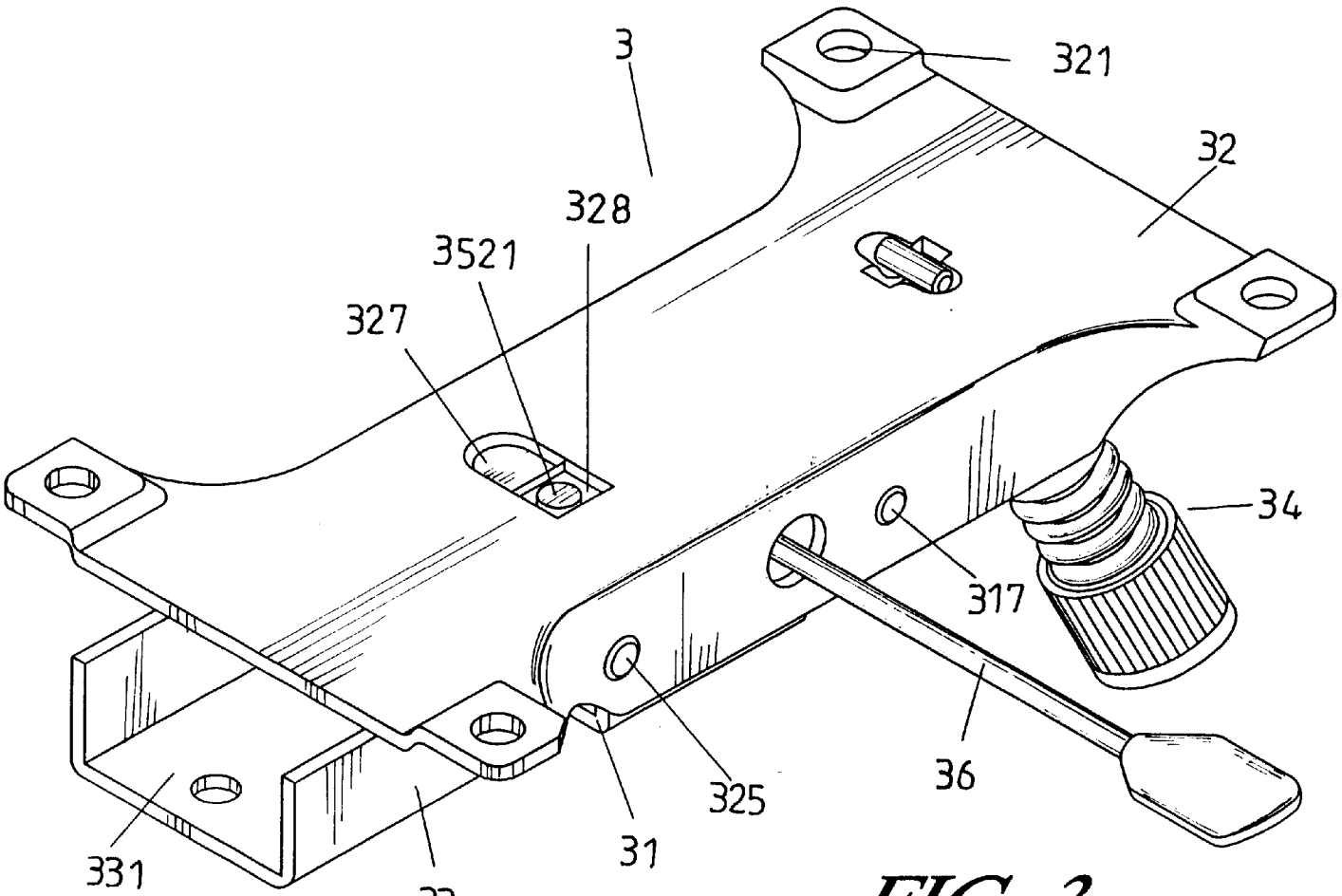
FIG. 3 is a perspective view of the chair seat chassis in FIG. 2.

The control device 35 includes a pressing plate 351 and an operative block 352. As illustrated in FIGS. 1 and 2, the pressing plate 351 includes an engaging portion 3511 in an end thereof for connection with the axle rod 318 and a pivotal portion 3512 on a lateral side thereof for connection with an inner end of the adjusting rod 36. The operative block 352 is mounted between the first connecting seat 31 and the swivel seat 32 and includes an upper end with a pressing portion 3521 that bears against the stop 327 of the swivel seat 32. A tubular member 3522 is securely attached to a side of the operative block 352 and fittingly mounted between two spaced lugs that constitute the engaging portion 3511. The axle rod 318 is extended through the tubular member 3522 and the engaging portion 3511 of the pressing plate 351.

In assembly, the first connecting seat 31, the swivel seat 32, and the second connecting seat 33 are connected together by axle rods 317, 318, and 325. Axle rod 318 is extended through the tubular member 3522 and the engaging portion 3511 of the pressing plate 351, thereby mounting the pressing plate 351 and the operative block 352 between the swivel seat 32 and the second connecting seat 33. In addition, the inner end of the adjusting rod 36 is engaged with the pivotal portion 3512 of the pressing plate 341 such that rotation of the adjusting rod 36 controls movement of the pressing plate 351 that presses against an upper end of the pneumatic rod 4, thereby adjusting the level of the chair seat 2.

Referring to FIG. 4, when the adjusting rod 36 is pulled outward, the pressing plate 351 and the operative block 352 are also moved outward until the pressing portion 3521 is aligned with the hole 328 of the swivel seat 32. In this status, the swivel seat 32 and the second connecting seat 33 may swivel back-and-forth. Referring to FIG. 5, when the adjusting rod 36 is pushed inward until the pressing portion 3521 of the operative block 352 is aligned with and thus stopped by the stop 327. Thus, back-and-forth swivel motions of the swivel seat 32 and the second connecting seat 33 are prevented.

Figure 7:
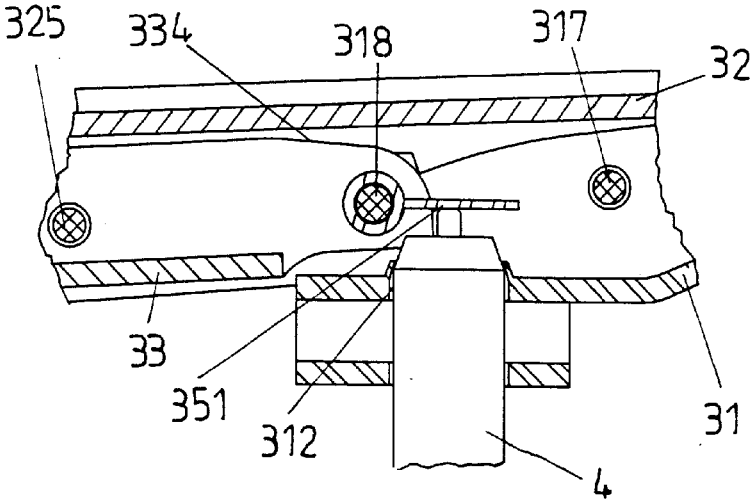
FIG. 7 is an enlarged sectional view of a portion of the chair in FIG. 6.
Figure 8:
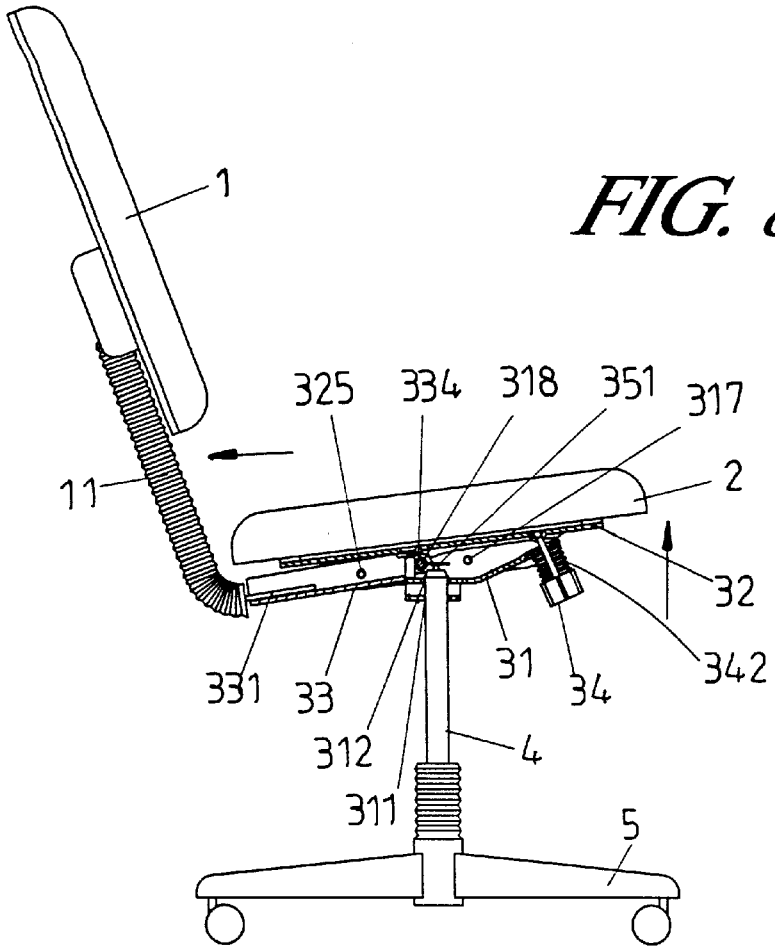
FIG. 8 is a sectional view similar to FIG. 6, illustrating swivel motion of the chair.
Figure 9:
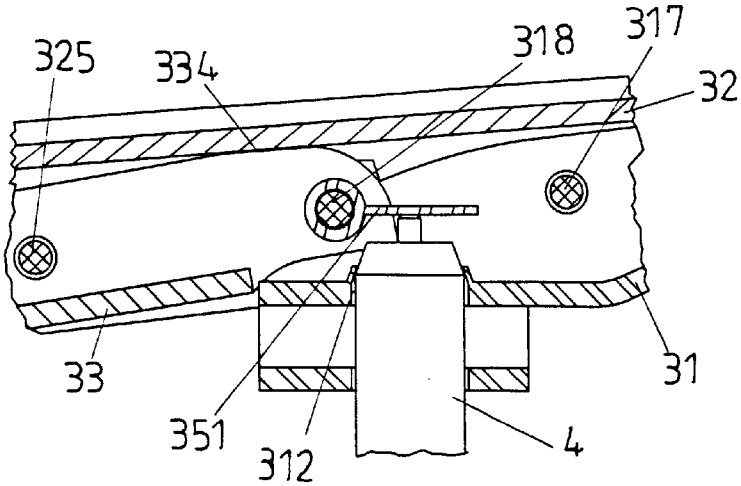
FIG. 9 is an enlarged sectional view similar to FIG. 8, illustrating a portion of the chair in FIG. 8.
Figure 10:
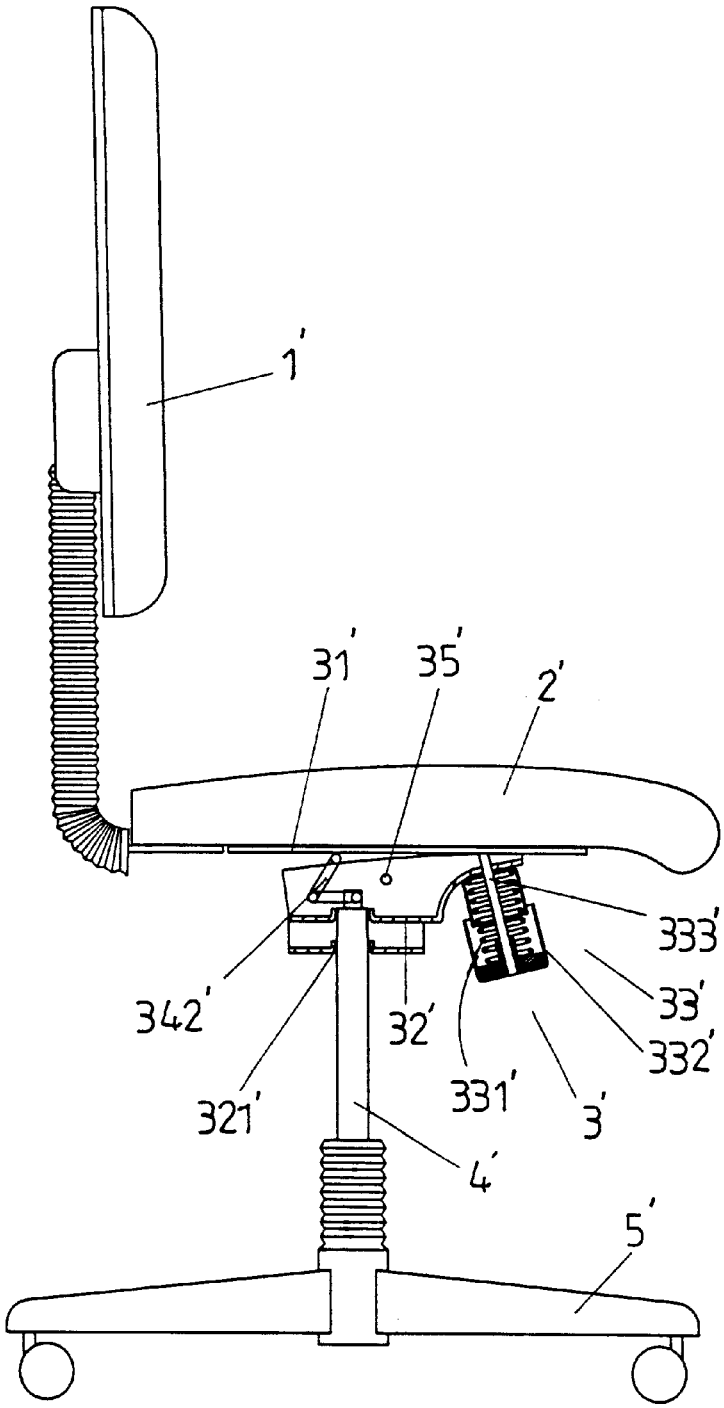
FIG. 10 Prior Art
FIG. 10 is a side view, partly sectioned, of a chair with a conventional chassis.
Figure 11:
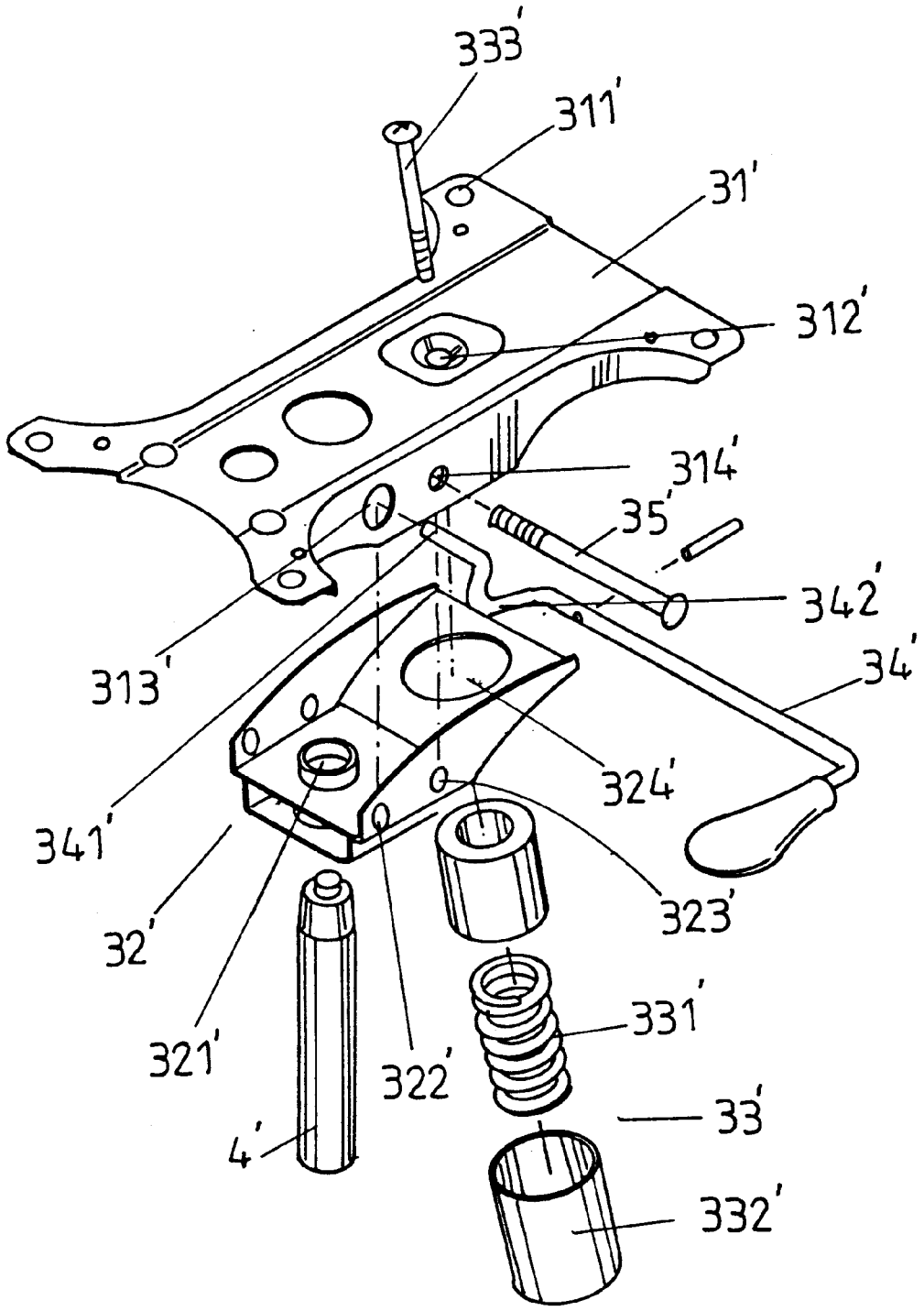
FIG. 11 Prior Art
FIG. 11 is an exploded view of the conventional chassis in FIG. 10.
Figure 12:
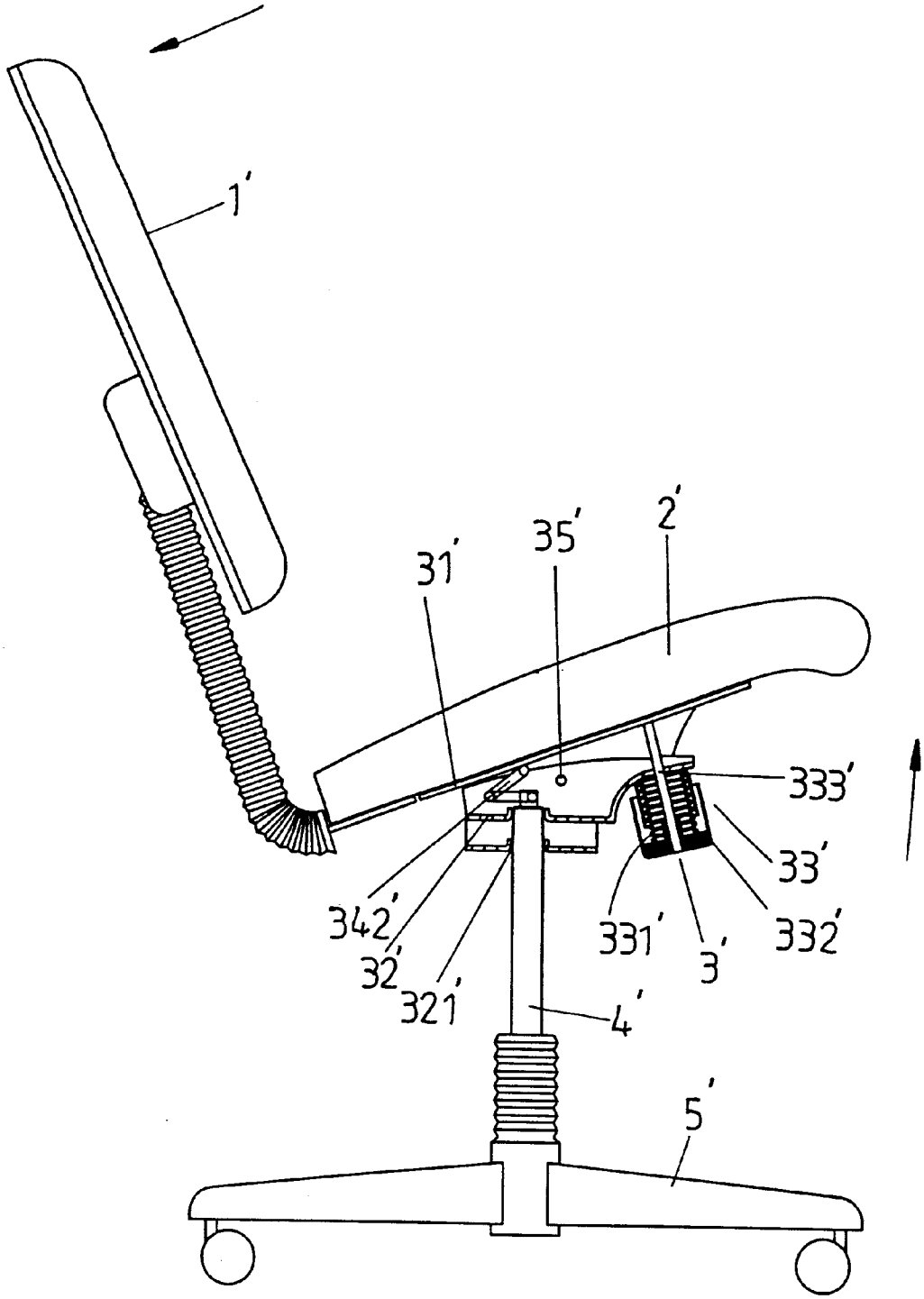
FIG. 12 Prior Art
FIG. 12 is a side view illustrating use of the chair in FIG. 10
Figure 13:
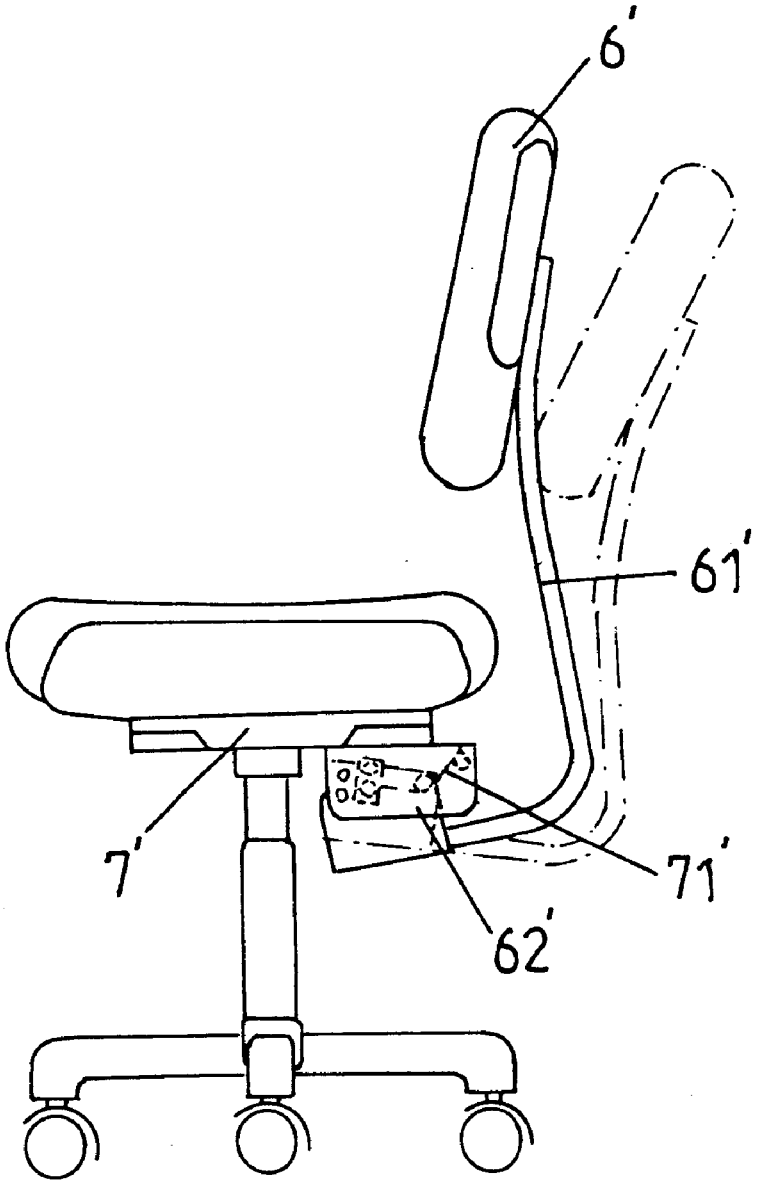
FIG. 13 Prior Art
FIG. 13 is a schematic side view of another conventional chair.

FIG. 6 illustrates a side view, partly sectioned, of the chair with the chassis in accordance with the present invention, and FIG. 7 is an enlarged sectional view illustrating detailed arrangement of the chassis. Referring to FIGS. 8 and 9, when the adjusting rod 36 is in a position shown in FIG. 4 and the user leans rearward against the backrest 1, the second connecting seat 33 is also swiveled rearward via transmission by the connecting post 11. The swivel seat 32 is also swiveled. Yet, the rearward swivel motion of the swivel seat 32 is much smaller than that of the second connecting seat 33 due to provision of the above-mentioned pivotal structure. Thus, the chair seat 2 is swiveled by a smaller extent to keep the chair in a more stable status, as the swivel seat 32 swivels by an angular displacement smaller than that of the second connecting seat 33. In addition, as shown in FIG. 9, when the rearward movement of the second connecting seat 33 is relatively large, the inclined upper surfaces of the extensions 334 bear against an underside of the swivel seat 32 to thereby prevent further rearward movement of the second connecting seat 33 and the backrest 1. Safety is thus improved.

According to the above description, it is appreciated that the chair seat swivels through a smaller angle although the backrest swivels through a considerable angle, thereby providing a stable chair with improved sitting comfort. The stability of the chair is further assured under provision of the inclined upper surfaces of the extensions 334 of the chassis that restrain rearward movement of the backrest 1. Only one adjusting rod is required to adjust the level of the chair seat and the swivel condition of the chair, and the adjustment is easy to achieve. In addition, assembly of the control device 35 and the adjusting rod 36 is easy.

Although the invention has been explained in relation to its preferred embodiment, it is to be understood that many other possible modifications and variations can be made without departing from the spirit and scope of the invention as hereinafter claimed.

What is claimed is:

1. A swivel arrangement of a chair having a backrest (1), a chair seat (2), a chassis (3), a pneumatic rod (4), and a base (5), the chassis (3) comprising:

a first connecting seat (31) includes an engaging section (311) with an engaging hole (312) through which the pneumatic rod (4) extends, the first connecting seat (31) including a hole (313) defined in a front end thereof, the first connecting seat (31) further including a hole (314)

in a lateral side thereof through which the adjusting rod (36) extends, the lateral side of the first connecting seat (31) further including two axle holes (315 and 316) through which two axle rods (317 and 318) extend, respectively, a swivel seat (32) adapted to be mounted to an underside of the chair seat (2), the swivel seat (32) including a hole (322) in a lateral side thereof through which the adjusting rod (36) extends, the lateral side of the swivel seat (32) further including two axle holes (323 and 324) through which two axle rods (317 and 325) extend, respectively, the swivel seat (32) including a hole (326) defined in a front end thereof, the swivel seat (32) further including a hole (328) and a stop (327) formed adjacent to the hole (328), the axle rod (317) being extended through the axle hole (315) in the first connecting seat (31) and the axle hole (323) in the swivel seat (32) to thereby connect the first connecting seat (31) with the swivel seat (32), a second connecting seat (33) including an engaging section (331) at a rear end thereof for connection with the backrest (1) via a connecting post (11), the connecting seat (33) including aligned axle holes (333) in two lateral sides thereof, an axle rod (325) being extended through the axle holes (333) in the second connecting seat (33) and the axle hole (324) in the swivel seat (32) to thereby connect the second connecting seat (33) with the swivel seat (2), each said lateral side of the second connecting seat (33) including an extension (334) with a hole (332), the axle rod (318) being extended through the axle hole (316) in the first connecting seat (31) and the holes (332) in the second connecting seat (33) to thereby connect the second connecting seat (33) with the first connecting seat (31), the axle holes (333) of the second connecting seat (33) being located in a position such that when the second connecting seat (33) swivels rearward, the swivel seat (32) swivels rearward by an angular displacement smaller than that of the second connecting seat (33), a spring seat (34) including a threaded rod (341), a spring (342), and a sleeve (343), the spring seat (34) being connected to a front end of an underside of the first connecting seat (31), the threaded rod (341) being extended through the hole (326) in the swivel seat (32) and the hole (313) in the first connecting seat (31) with a threaded end of the threaded rod (341) engaged with a bottom end of the sleeve (343) and with an upper end of the spring (342) bearing against the underside of the first connecting seat (31), a control device (35) including a pressing plate (351) and an operative block (352), the pressing plate (351) including an engaging portion (3511) in an end thereof for connection with the axle rod (318) and a pivotal portion (3512) on a lateral side thereof for connection with an inner end of the adjusting rod (36), the operative block (352) being mounted between the first connecting seat (31) and the swivel seat (32) and including an upper end with a pressing portion (3521) that bears against the stop (327) of the swivel seat (32), a tubular member (3522) being securely attached to a side of the operative block (352) and pivotally connected to the engaging portion (3511) of the pressing plate (351) by the axle rod (318), the inner end of the adjusting rod (36) being engaged with the pivotal portion (3512) of the pressing plate (341) such that rotation of the adjusting rod (36) controls movement of the pressing plate (351) that presses against an upper end of the pneumatic rod (4), thereby adjusting level of the chair seat (2), whereby the adjusting rod is movable along a longitudinal axis thereof between a first position and a second position, wherein when the adjusting rod is in the first position, the pressing portion (3521) of the operative block (352) is aligned with the hole (328) of the swivel seat (32) to allow back-and-forth swivel movements of the swivel seat (32) and the second connecting seat (33), and wherein when the adjusting rod is in the second position, the pressing portion (3521) of the operative block (352) is aligned with and thus stopped by the stop (327) of the swivel seat (32) to thereby prevent back-and-forth swivel movements of the swivel seat (32) and the second connecting seat (33).

2. The swivel arrangement as claimed in claim 1, wherein each said extension (334) of the second connecting seat includes an inclined upper surface for bearing against the swivel seat to limit rearward swivel movement of the second connecting seat.

* * * * *